US009323197B2

(12) United States Patent
Ito et al.

(10) Patent No.: US 9,323,197 B2
(45) Date of Patent: Apr. 26, 2016

(54) HISTORY STORAGE DEVICE, IMAGE FORMING APPARATUS AND NON-TRANSITORY COMPUTER READABLE MEDIUM STORING PROGRAM

(71) Applicant: FUJI XEROX CO., LTD., Minato-ku, Tokyo (JP)

(72) Inventors: Atsuhiro Ito, Yokohama (JP); Masashi Murakami, Yokohama (JP); Atsuo Matsunaga, Yokohama (JP); Keiji Ishiguro, Yokohama (JP); Masayuki Kudo, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/516,789

(22) Filed: Oct. 17, 2014

(65) Prior Publication Data

US 2015/0316883 A1 Nov. 5, 2015

(30) Foreign Application Priority Data

Apr. 30, 2014 (JP) ..... 2014-093832

(51) Int. Cl.
*G03G 15/00* (2006.01)

(52) U.S. Cl.
CPC ..... *G03G 15/50* (2013.01)

(58) Field of Classification Search
CPC ..... G03G 2215/0697
See application file for complete search history.

(56) References Cited

U.S. PATENT DOCUMENTS 6,430,711 B1 * 8/2002 Sekizawa ..... G06F 11/3006 358/1.14
2004/0257613 A1 12/2004 Okabe et al.
(Continued)

FOREIGN PATENT DOCUMENTS

JP 2004-310215 A 11/2004
JP 2005-059336 A 3/2005
(Continued)

OTHER PUBLICATIONS

JP_2013033149_A_T Machine Translation.*

*Primary Examiner* — Clayton E LaBalle
*Assistant Examiner* — Victor Verbitsky
(74) *Attorney, Agent, or Firm* — Sughrue Mion, PLLC

(57) ABSTRACT

A history storage device includes: a storage unit that, in storing first history information including phenomenon information corresponding to a phenomenon having occurred and accompanying information accompanying the phenomenon information in a storage region, when the phenomenon information included in the first history information is duplication of phenomenon information included in second history information having already been stored in the storage region, deletes the phenomenon information included in the first history information and stores, in the storage region, the accompanying information which is included in the first history information and is associated with the phenomenon information; and a reconstruction unit that, in reading out the first history information from the storage region, based on the phenomenon information with which the accompanying information included in the first history information is associated, reconstructs the deleted phenomenon information, to thereby reconstruct the first history information including the phenomenon information and the accompanying information.

14 Claims, 8 Drawing Sheets

(56) References Cited

U.S. PATENT DOCUMENTS

2005/0036793 A1 2/2005 Endo
2007/0070401 A1* 3/2007 Okamoto ..... G06F 3/1222
358/1.15

FOREIGN PATENT DOCUMENTS

JP 2007-323463 A 12/2007
JP 2013033149 A * 2/2013

* cited by examiner

FIG.4

XXX PRINTER ERROR REPORT

Ji

Kp

| | EVENT CODE | DATE AND TIME OF OCCURRENCE |
|---|---|---|
| 1 | 07-16 | 14-02-20 15:35 |
| 2 | 80-20 | 14-02-20 17:06 |
| 3 | 07-16 | 14-02-21 08:49 |
| 4 | 316-770 | 14-02-22 11:45 |
| 5 | | |
| 6 | | |
| 7 | | |
| 8 | | |
| 9 | | |
| 10 | | |
| 11 | | |
| 12 | | |
| 13 | | |
| 14 | | |
| 15 | | |
| 16 | | |
| 17 | | |
| 18 | | |
| 19 | | |
| 20 | | |

HISTORY STORAGE DEVICE, IMAGE FORMING APPARATUS AND NON-TRANSITORY COMPUTER READABLE MEDIUM STORING PROGRAM

CROSS REFERENCE TO RELATED APPLICATION

This application is based on and claims priority under 35 USC §119 from Japanese Patent Application No. 2014-093832 filed Apr. 30, 2014.

BACKGROUND

1. Technical Field

The present invention relates to a history storage device, an image forming apparatus and a non-transitory computer readable medium storing a program.

2. Related Art

Some image forming apparatuses store information related to a print job in forming an image or information related to operation of the image forming apparatus as history information.

SUMMARY

According to an aspect of the present invention, there is provided a history storage device including: a storage unit that, in storing first history information including phenomenon information corresponding to a phenomenon having occurred and accompanying information accompanying the phenomenon information in a storage region, when the phenomenon information included in the first history information is duplication of phenomenon information included in second history information having already been stored in the storage region, deletes the phenomenon information included in the first history information and stores, in the storage region, the accompanying information which is included in the first history information and is associated with the phenomenon information; and a reconstruction unit that, in reading out the first history information from the storage region, based on the phenomenon information with which the accompanying information included in the first history information is associated, reconstructs the deleted phenomenon information, to thereby reconstruct the first history information including the phenomenon information and the accompanying information.

BRIEF DESCRIPTION OF THE DRAWINGS

Exemplary embodiments of the present invention will be described in detail based on the following figures, wherein:

FIG. 4 is a diagram showing an example of an output form of log information listed in chronological order of date of occurrence;

DETAILED DESCRIPTION

Hereinafter, exemplary embodiments according to the present invention will be described with reference to attached drawings.

First Exemplary Embodiment

Configuration of Image Forming Apparatus 10

Figure 1:
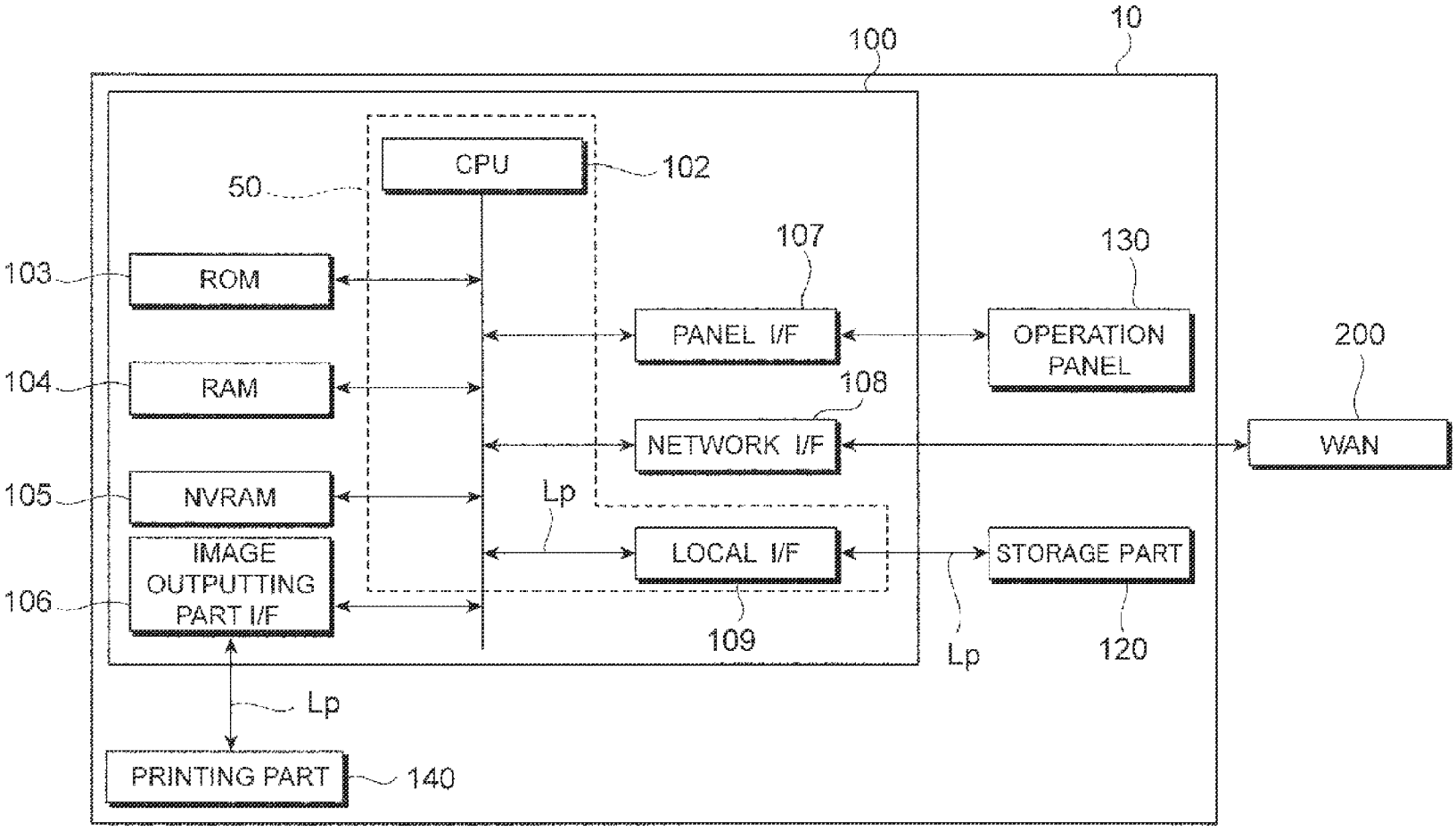
FIG. 1 is a block diagram exemplifying a hardware configuration of an image forming apparatus related to a first exemplary embodiment according to the present invention.

FIG. 1 is a block diagram exemplifying a hardware configuration of an image forming apparatus 10 related to a first exemplary embodiment according to the present invention. The image forming apparatus 10 of the first exemplary embodiment includes: a storage part 120; an operation panel 130; a printing part 140 (an example of an image forming part); and an image forming controller 100. These storage part 120, operation panel 130, printing part 140 and image forming controller 100 are connected to one another, and transmit and receive document data (data including image information, the same shall apply hereafter) and control signals with one another.

Moreover, the image forming controller 100 is connected to a WAN (Wide Area Network) 200, to which a user client (illustration thereof is omitted) or the like is connected.

The storage part 120 is configured with, for example, an HDD (Hard disk drive) having a storage region for storing information, and stores, for example, document data or the like received from the user client via the WAN 200 and log information Lp (history information (first history information, second history information, . . . ), p is a number of events (phenomena) that have occurred (p=1, 2, . . . )) corresponding to events that have occurred.

The event means information related to details of operation of each constituent component of the image forming apparatus 10, information related to details of instruction received by the image forming apparatus 10, information related to the status of each constituent component of the image forming apparatus 10, information related to an error, or the like.

It should be noted that the document data stored in the storage part 120 is not only limited to those inputted through the WAN 200, but may also be, for example, inputted by an image inputting part, illustration of which is omitted.

Moreover, the log information Lp (the first history information) means one that is an object of storing operation into the storage region, or one that is an object of reading operation from the storage region. On the other hand, the log information Lp (the second history information) means one that has already been stored in the storage region, which is not the object of storing operation into the storage region and is not the object of reading operation from the storage region.

The operation panel 130 is, for example, configured with a touch panel display made of liquid crystal, and displays data related to, for example, the image forming apparatus 10 under the control of a program executed by the image forming controller 100. Moreover, the operation panel 130 displays a display screen for receiving operation from a user, and receives the operation from the user through the display screen.

The printing part 140 prints a toner image corresponding to the above-described document data onto a supplied sheet (an example of a recording medium, illustration thereof is omitted) by, for example, an electrophotographic process. Further, the printing part 140 prints the log information Lp stored in the storage part 120 onto the sheet.

The image forming controller 100 performs control of operations of the storage part 120, the operation panel 130 and the printing part 140. The image forming controller 100 is configured with: a CPU (Central Processing Unit) 102; a ROM (Read Only Memory) 103; a RAM (Random Access Memory) 104; an NVRAM (Non Volatile RAM) 105; an image outputting part I/F (image outputting part interface) 106; a panel I/F (panel interface) 107; a network I/F (network interface) 108 and a local I/F (local interface) 109.

The ROM 103 stores a program executed by the CPU 102. The CPU 102 reads the program stored in the ROM 103 and executes the program using the RAM 104 as a work area. The NVRAM 105 is a nonvolatile memory capable of retaining information having been stored without supplying electrical power, and, for example, appliance management information such as system information (machine setting information and the like) and user information such as a facsimile address book are stored therein.

The image outputting part I/F 106 carries out communication of the document data, the control data and the log information Lp with the printing part 140. The panel I/F 107 carries out communication of the control data with the operation panel 130. The network I/F 108 is connected to a WAN 200, to which the user client is connected, and carries out communication of the document data and control signals. The local I/F 109 carries out communication of the document data, the control signals and the log information Lp with the printing part 120.

It should be noted that the program execute by the CPU 102 is capable of being provided in a state of being stored in a storage medium readable by a computer, such as a magnetic storage medium (a magnetic tape, a magnetic disk or the like), an optical storage medium (an optical disk or the like), a magneto-optical storage medium and a semiconductor memory. Moreover, the program is able to be downloaded to the image forming apparatus 10 or the like by use of a communication tool.

<Image Forming Operation of Image Forming Apparatus 10>

When the CPU 102 reads out and executes the program stored in the ROM 103, the storage part 120, the operation panel 130 and the printing part 140 of the image forming apparatus 10 are controlled by the program.

For example, when a print request of document data from the user client is inputted to the network I/F 108 of the image forming controller 100 through the WAN 200, in accordance with the program, the CPU 102 causes the storage part 120 to temporarily store the document data inputted with the print request via the local I/F 109.

Here, when a user inputs his/her ID (identification) number or the like onto the display screen of the operation panel 130, the CPU 120 causes the document data, on which the print request has been issued from the user client corresponding to the ID number and which has been stored in the storage part 120 to wait for an instruction to start printing, to be displayed on the display screen of the operation panel 130 through the panel I/F 107. It should be noted that, when print request of plural pieces of document data from the user client is stored in the storage part 120, the plural pieces of document data waiting for the instructions to start printing are displayed in a list form on the display screen of the operation panel 130.

On the display screen of the operation panel 130, the user selects at least one piece of document data that is waiting for instruction to start printing, and inputs the instruction to start printing onto the operation panel 130.

The instruction to start printing inputted to the operation panel 130 is interpreted by the CPU 102 through the panel I/F 107, and the CPU 102 reads out the document data selected by the user from the storage part 120 through the local I/F 109. Then, the document data read out of the storage part 120 is subjected to the process by the program executed by the CPU 102, which uses the RAM 104 as the work area, and thereafter, inputted to the printing part 140 via the image outputting part I/F 106.

Under the control of the image forming controller 100 through the image outputting part I/F 106, the printing part 140 prints a toner image corresponding to the inputted document data onto a sheet.

<Operation Related to Log Information Lp>

Other than the above-described image forming function, the image forming apparatus 10 of the exemplary embodiment has, in a case where trouble such as an abnormal operation occurs, with an intention of analyzing the trouble afterwards, a function of storing log information Lp (the first history information) when an event (phenomenon) such as the trouble occurs in a storage region of the storage part 120 and a function of reading out the log information Lp stored in the storage region and printing thereof onto a sheet.

Here, the log information Lp is configured by combining event information Ji (phenomenon information) that is coded corresponding to the type of event i and date and time information Kp (accompanying information) that accompanies the event information Ji and corresponds to the date and time of occurrence of the event. The event information Ji has an information amount of, for example, 4 bytes, which is different in each type of event i. On the other hand, the date and time information Kp has an information amount of, for example, 6 bytes, which is a combination of date and time.

The event set as the event information Ji is, for example, an event that occurs related to supply of sheets or image formation onto a sheet, and specifically, the event includes information about an original or a sheet, power supply control information, information of job execution such as printing of document data, error information (such as sheet jam information or information about running out of sheets, information about running out of toner, information about temperature abnormality or information about operation abnormality) or the like. The event is not limited to those described above, but may include a change of condition occurred inside the image forming apparatus 10 or the like.

The function of storing the log information Lp in the storage region of the storage part 120 is implemented by causing the CPU 102 to read out the program stored in the ROM 103 and to execute a process in accordance with a command described in the program.

Specifically, when the event of running out of the sheets occurs, the CPU 102 generates log information Lp (the first history information) including the event information Ji and the date and time information Kp corresponding to the type of the event of running out of the sheets i, and stores the generated log information Lp in the storage region of the storage part 120 through the local I/F 109.

Figure 2:
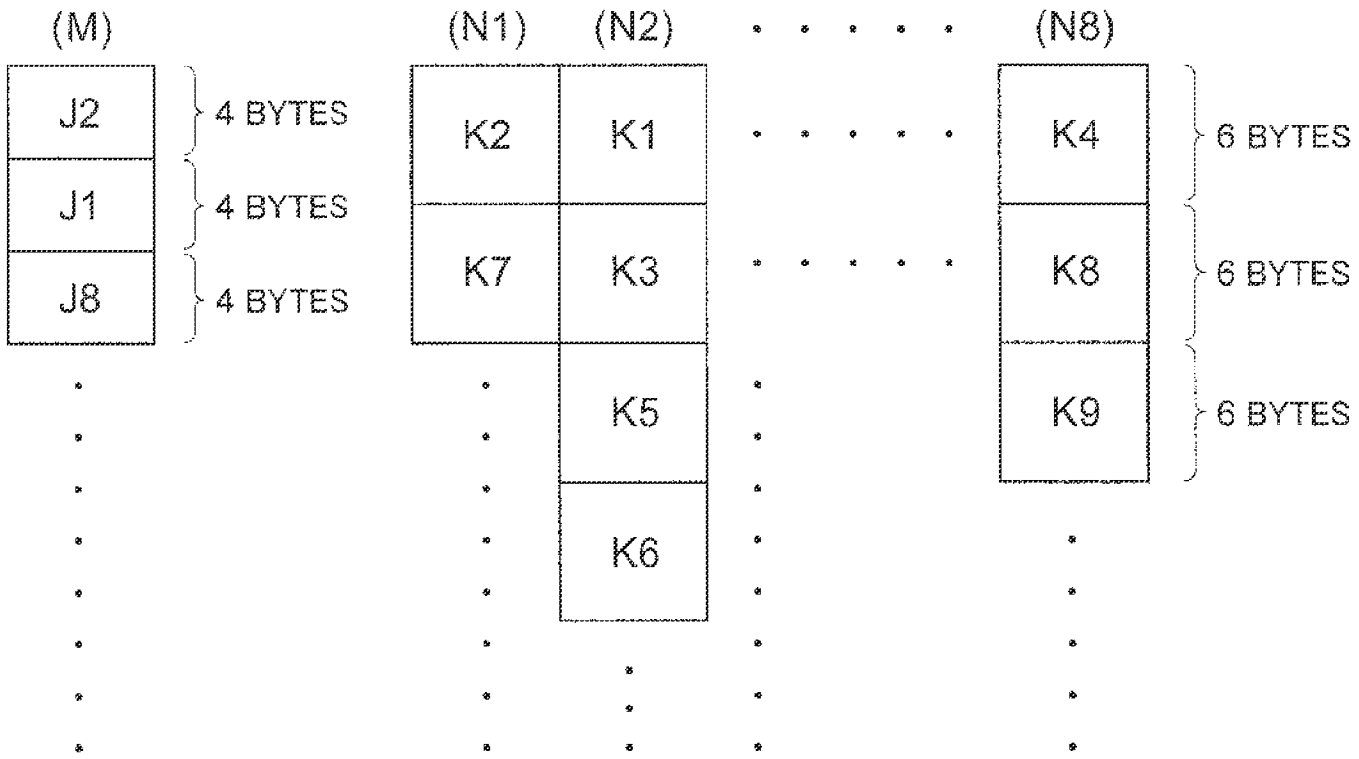
FIG. 2 is a schematic diagram showing a management table region and an each event region set in a storage region of a storage part.

FIG. 2 is a schematic diagram showing a management table region M and an each event region Ni (i=1, 2, . . . , 8, Ni=N1, N2, . . . , N8) (a group information region) set in the storage region of a storage part 120. When the CPU 102 stores the log information Lp in the storage region of the storage part 120, the CPU 102 sets two storage regions of the management table region M and the each event region Ni in the storage region of the storage part 120.

The each event region Ni is set corresponding to each event information Ji, that is, each type of event i. In other words, in the first exemplary embodiment, since 8 event types i (i=1, 2, . . . , 8) stored as the log information Lp are set, there exist 8 types of event information Ji, namely, J1, J2, . . . , J8. Then, in regard to the each event region Ni, in such a way that the each event region Ni corresponds to the event information J1 and the each event region N2 corresponds to the event information J2, the each event regions N1, N2, . . . , N8 are set one by one corresponding to the event information J1, J2, . . . , J8, respectively.

It should be noted that that each event region Ni is not set in advance, but is set when an event of a new type occurs, as will be described later.

When the CPU 102 stores the log information Lp in the storage region, the CPU 102 stores only the event information Ji included in the log information Lp in the management table region M. The event information Ji to be stored in the management table region M may be stored with a file name corresponding to the event information Ji. The file name is generated by the CPU 102 dynamically corresponding to the event information Ji.

The CPU 102 causes the storage part 120 to store only the event information Ji included in the log information Lp in the management table region M, and to set the each event region Ni corresponding to the event information Ji. Further, the CPU 102 deletes the event information Ji from the log information Lp to leave only the date and time information Kp, and stores the data and time information Kp having been left in the each event region Ni that has been set.

In other words, for example, when the event information included in the log information Lp (the first history information) to be stored is J2, the event information J2 included in the log information Lp, which will be stored, is stored in the management table region M, and the each event region N2 corresponding to the event information J2 is set. Further, the event information J2 included in the log information Lp (the first history information) to be stored is deleted to leave only the date and time information Kp, and the date and time information Kp included in the log information Lp (the first history information) to be stored is stored in the each event region N2 that has been set corresponding to the event information J2.

Consequently, the log information Lp (the first history information) to be stored is stored in the storage region of the storage part 120 as the date and time information Kp associated with the event information J2 included in the log information Lp (the first history information).

Every time an event occurs, the CPU 102 stores the log information Lp in the storage region of the storage part 120 by the above-described process; however, if event information Ji included in the log information Lp (the first history information) of the event that newly occurs is same as the event information Ji associated as another log information Lp (second history information) having already been stored in the management table M (duplication exists), the CPU 102 deletes the event information Ji included in the log information Lp (the first history information) of the event that newly occurs, and stores date and time information Kp included in the log information Lp (the first history information) in the each event region Ni corresponding to the same event information Ji.

At this time, since the event information Ji included in the newly-occurred log information Lp (the first history information) has been deleted, the event information Ji is not stored in the management table region M. However, the date and time information Kp of the newly-stored log information Lp is stored in the each event region Ni corresponding to the event information Ji that is same as the event information Ji included in the log information Lp and having already been stored in the management table region M, and therefore, the date and time information Kp is substantially associated with the event information Ji included in the log information Lp and stored in the storage region of the storage part 120.

Figure 3:
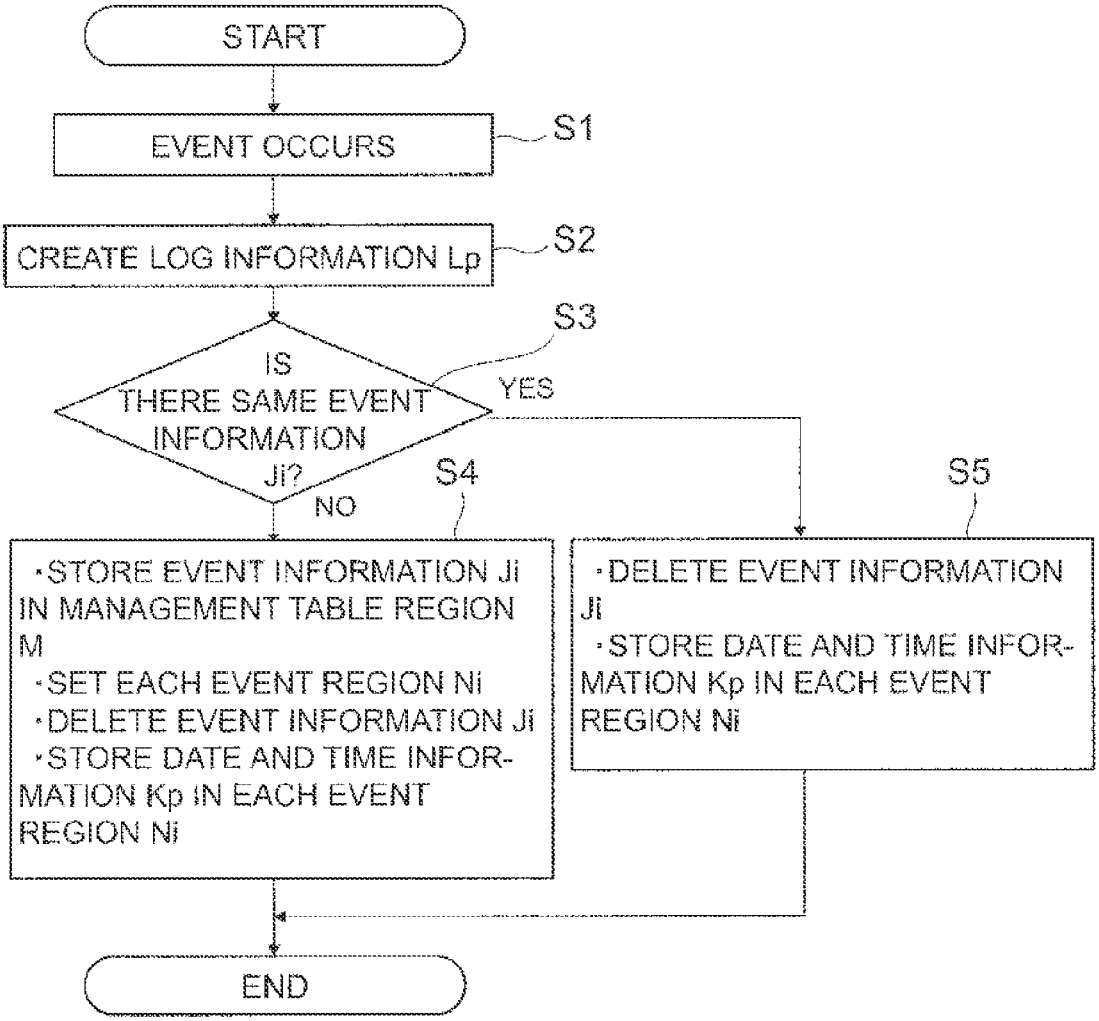
FIG. 3 is a flowchart showing a process of storing log information executed by a CPU.

FIG. 3 is a flowchart showing a process of storing the log information Lp executed by the CPU 102. As shown in FIG. 3, when an event occurs (S1), the CPU 102 creates log information Lp corresponding to the event (S2). Subsequently, the CPU 102 determines whether or not event information Ji same as the event information Ji included in the created log information Lp has already been stored in a management table region M (S3).

When it is determined that the same event information Ji does not exist in the management table region M (NO in S3), the CPU 102 stores the event information Ji included in the log information Lp in the management table region M, and sets an each event region Ni corresponding to the event information Ji. Further, the CPU 102 deletes the event information Ji from the log information Lp, and stores the data and time information Kp having been left in the each event region Ni that has been set (S4), to thereby complete the process.

On the other hand, when it is determined that the same event information Ji exists in the management table region M (YES in S3), the CPU 102 deletes the event information Ji from the log information Lp, and stores the date and time information Kp having been left in the each event region Ni corresponding to the deleted event information Ji (S5), to thereby complete the process.

By repeating the above process every time an event occurs, the log information Lp is stored in the management table region M and the each event regions N1, N2, . . . . , N8 of the storage part 120, as shown in FIG. 2.

Here, since the duplicate event information Ji is not stored in the management table region M according to the above-described process, regardless of the number p of events that have occurred, in the management table region M, merely eight pieces of event information J1 to J8 set as the event information Ji are stored at the maximum. Each event information Ji is set to 4 bytes, and accordingly, an information amount to be stored in the management table region M is 32 bytes (=4 bytes×8) at the maximum.

On the other hand, since the date and time information Kp of 6 bytes is stored in the each event regions N1 to N8 every time an event occurs, an information amount stored in the each event regions N1 to N8 increases in proportion to the number p of events having occurred, and the information amount is 6p bytes (=6 bytes×p).

Consequently, in the storage region of the storage part 120, the log information Lp occupies the regions of (32+6p) bytes in total.

In contrast, in a case where the log information Lp of each occurrence of an event is stored in, for example, a common region set for storing the log information Lp, of the storage region of the storage part 120 without being subjected to the process, since an information amount of a piece of log information Lp is 10 bytes (=event information of 4 bytes+date and time information of 6 bytes), the log information Lp occupies the regions of 10p bytes in total in the common region of the storage part 120.

Here, when a case of the first exemplary embodiment and a case where the log information Lp is stored in the storage region of the storage part 120 as it is without adopting the process of the first exemplary embodiment (hereinafter, referred to as "case where the present invention is not adopted") are simply compared, when the number p of events that have occurred is not less than 9, the first exemplary embodiment is able to reduce the region to occupy in the storage region of the storage part 120, as compared to the case where the present invention is not adopted.

However, the simple comparison hypothesizes a case where the eighth event occurs without any duplication of the type i of the occurring event, but in actuality, there is a very low possibility that all of the events of the type i occur without any duplication until occurrence of the eighth event.

To the contrary, for example, in a case where an event that has occurred at the first time and an event that has occurred at the second time are the events of the same type, in the first exemplary embodiment, the log information Lp occupies the regions of 16 bytes in total in the storage region of the storage part 120 because an information amount of 4 bytes corresponding to a piece of event information Ji can be reduced. On the other hand, in a mode not adopting the present invention, the log information Lp occupies the regions of 20 bytes in total in the storage region of the storage part 120.

As compared to the case where the present invention is not adopted, the first exemplary embodiment is able to reduce the information amount of the log information Lp that is to be stored when the second event occurs. Furthermore, also at the time of occurrence of the first event, the information amount of the log information Lp to be stored in the first exemplary embodiment does not exceed the information amount of the log information Lp to be stored in the case where the present invention is not adopted (10 bytes).

Therefore, according to the image forming apparatus 10 and the program of the first exemplary embodiment, the information amount to be stored as the log information Lp in the storage part 120 is able to be reduced as a whole.

The CPU 102 and the local I/F 109 in the first exemplary embodiment corresponds to the log storage device 50, which is an example of a history storage device according to the present invention, by functioning as a storage unit that stores, in the each event region, the date and time information Kp of the log information Lp which is associated with the event information Ji.

Accordingly, also by the log storage device 50 of the first exemplary embodiment, the information amount to be stored as the log information Lp in the storage part 120 is able to be reduced as a whole.

It should be noted that, as described above, it is sufficient for the management table region M in the first exemplary embodiment to set regions of 32 bytes at the maximum; however, the date and time information Kp to be stored in the each event region Ni increases in proportion to the number i of occurrence of events. In regard to the each event region Ni, the number i of occurrence of events is estimated, and when the each event region Ni is set, the each event region Ni is set as the regions having a size capable of storing the date and time information Kp corresponding to the estimated number i.

However, in a case where the number of events that actually occur becomes more than the estimation, the each event region Ni does not have an empty region enough to store the date and time information Kp of the log information Lp that corresponds to an event that has newly occurred.

Accordingly, in this case, log information Lp corresponding to a new event may be stored as a priority by writing the date and time information Kp of the log information Lp that has occurred latest over the oldest date and time information Kp of the pieces of date and time information Kp stored in the same each event region Ni.

Moreover, as another storage region, which is different from the each event region Ni set in advance, a common region for storing log information Lp regardless of the type of an event may be set. Then, the date and time information Kp of the log information Lp that has occurred latest may not be stored by overwriting the each event region Ni having no empty region, but the whole log information Lp may be stored in the common region without deleting the event information Ji from the log information Lp.

Furthermore, regarding the log information Lp that has occurred latest, it may be unnecessary to write the date and time information Kp of the log information Lp over the each event region Ni already having no empty region or to store the whole log information Lp in the common region, and accordingly, the log information Lp may not be stored in the storage part 120.

<Reconstruction Unit>

The log information Lp stored in the storage part 120 in the first exemplary embodiment is used in maintenance or the like by being read out afterward.

The log storage device 50 and the image forming apparatus 10 of the first exemplary embodiment includes an example of a reconstruction unit that reconstructs deleted event information Ji, which is accompanied by the date and time information Kp, based on the event information Ji associated with the date and time information Kp stored in the each event region Ni. The reconstruction unit is implemented by causing the CPU 102 to read out the program stored in the ROM 103 and to execute a process in accordance with a command described in the program.

Specifically, the CPU 102 reads out the pieces of event information Ji stored in the management table region M (refer to FIG. 2) of the storage part 120 through the local I/F 109 in the order of stored regions. At this time, every time the CPU 102 reads out a piece of event information Ji, the CPU 102 refers to the each event region Ni that has been set corresponding to the event information Ji, to thereby read out the date and time information Kp stored in the corresponding each event region Ni in the order of stored regions. The CPU 102 further reconstructs the event information Ji that has been associated with the read-out date and time information Kp and deleted, based on the each event region Ni in which the date and time information Kp has been stored.

Then, the CPU 102 combines the reconstructed event information Ji and the date and time information Kp to reconstruct the log information Lp, and temporarily stores the reconstructed log information Lp in the RAM 104 or in a temporary file of the storage part 120.

After storing all pieces of log information Lp in the RAM 104 or the temporary file of the storage part 120, the CPU 102 sorts the all pieces of log information Lp in the chronological order of date of occurrence based on the date and time information Kp. Then, a list of the log information Lp sorted in the chronological order of date of occurrence is inputted to the printing part 140 through the image outputting part I/F 106 by the CPU 102.

FIG. 4 is a diagram showing an example of an output form of the log information Lp listed in chronological order of date of occurrence (refer to FIG. 1). Under the control of the CPU 102, the printing part 140 adds a title ("XXX Printer Error Report") and a name of each item ("Event Code (event information Ji)" and "Date and Time of Occurrence (date and time information KO") to the inputted list of the log information Lp as shown in FIG. 4, and outputs the list onto a sheet.

In this manner, when the log information Lp stored in the storage region of the storage part 120 is read out, the CPU 102 in the first exemplary embodiment is an example of the reconstruction unit that reconstructs the event information Ji, which has been associated with the date and time information Kp and has been deleted, based on the event information Ji associated with the date and time information Kp.

By the first exemplary embodiment as configured above, it is possible to reconstruct the event information Ji, which has been deleted in being stored in the storage region, in printing, and use the information as the printed log information Lp.

It should be noted that the above description is provided for the case where all the pieces of log information Lp are printed. However, for example, when log information Lp of specific event information Ji is printed, by selecting the event information Ji and inputting a print instruction thereof from the operation panel 130, the CPU 102 reads out the stored date and time information Kp only from the each event region Ni corresponding to the specific event information Ji inputted to the operation panel 130. Then, by the process same as that of the above description, the CPU 102 may reconstruct the specific event information Ji, combine each date and time information Kp having been read out and the event information Ji to reconstruct the log information Lp, to thereby cause the printing part 140 to print the reconstructed log information Lp.

Second Exemplary Embodiment

In the log storage device 50, the image forming apparatus 10 and the program of the first exemplary embodiment, when event information Ji corresponding to an event that has newly occurred does not exist in the management table region M, the CPU 102 sets the each event region Ni. However, according to the present invention, in the first exemplary embodiment, in setting the each event region Ni, the CPU 102 may set the each event region Ni only when a preset condition is satisfied.

Figure 5:
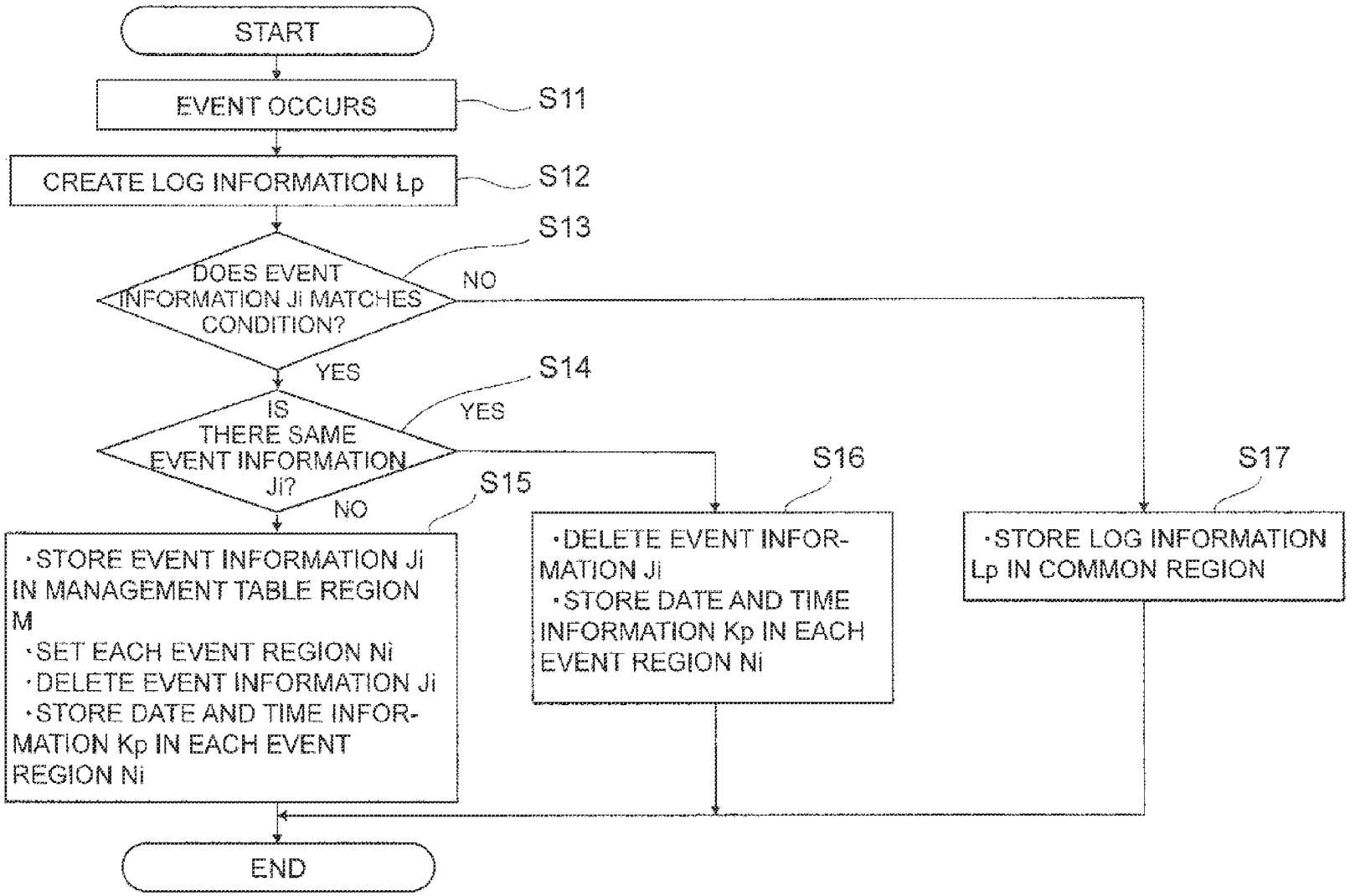
FIG. 5 is a flowchart showing a second exemplary embodiment in which, in the first exemplary embodiment, only when event information satisfies a preset condition, the CPU sets the each event region.

FIG. 5 is a flowchart showing a second exemplary embodiment according to the present invention in which, in the first exemplary embodiment, only when event information Ji satisfies a preset condition, the CPU 102 sets the each event region Ni. It should be noted that the hardware configuration for executing a process of the second exemplary embodiment is same as that in the first exemplary embodiment as shown in FIG. 1.

As shown in FIG. 5, when an event occurs (S11), the CPU 102 in the second exemplary embodiment creates log information Lp corresponding to the event (S12). Subsequently, the CPU 102 determines whether or not event information Ji included in the created log information Lp matches a preset condition (S13).

The preset condition has been set by an administrator or a user, and the condition may be stored in the NVRAM 105 or the storage part 120, or may be set in advance in the program executed by the CPU 102.

Moreover, for example, in a case where there are imbalances in frequency of occurrence among the types of events to occur due to a status of use or an environment of the image forming apparatus 10, if only the log information Lp including event information Ji corresponding to an event of a type of high frequency of occurrence is to be stored in a form in association with the event information Ji, the event information Ji of high frequency of occurrence may be set as the preset condition.

If it is determined by the CPU 102 that the event information Ji in the created log information Lp matches the preset condition (for example, the event information Ji is the event information Ji of high frequency of occurrence) (YES in S13), the CPU 102 determines whether or not event information Ji same as the event information Ji included in the created log information Lp has already been stored in the management table region M (S14).

When it is determined that the same event information Ji does not exist in the management table region M (NO in S14), the CPU 102 stores the event information Ji included in the log information Lp in the management table region M, and sets an each event region Ni corresponding to the event information Ji. Further, the CPU 102 deletes the event information Ji from the log information Lp, and stores the data and time information Kp having been left in the each event region Ni that has been set (S15), to thereby complete the process.

On the other hand, when it is determined that the same event information Ji exists in the management table region M (YES in S14), the CPU 102 deletes the event information Ji from the log information Lp, and stores the date and time information Kp having been left in the each event region Ni corresponding to the deleted event information Ji (S16), to thereby complete the process.

Moreover, if it is determined by the CPU 102 that the event information Ji in the created log information Lp does not match the preset condition (for example, the event information Ji is not the event information Ji of high frequency of occurrence) (NO in S13), the CPU 102 stores the log information Lp, in which the event information Ji and the date and time information Kp are still combined, in the common region described in the first exemplary embodiment (S17), to thereby complete the process.

With the log storage device 50, the image forming apparatus 10 and the program of the second exemplary embodiment as configured above, in addition to the operations and effects of the first exemplary embodiment, it is possible to obtain flexibility to select storing the log information Lp in a form in which the date and time information Kp is associated with the event information Ji in response to the preset condition.

Third Exemplary Embodiment

In the log storage device 50, the image forming apparatus 10 and the program of the first exemplary embodiment, the CPU 102 sets the each event region Ni not only when the event information Ji corresponding to an event that has newly occurred is created on the second occurrence or later, but also when the event information Ji is created on the first occurrence. However, according to the present invention, in the first exemplary embodiment, the each event region Ni may be set when the same type of event information Ji occurs more than a specific number of times.

Figure 6:
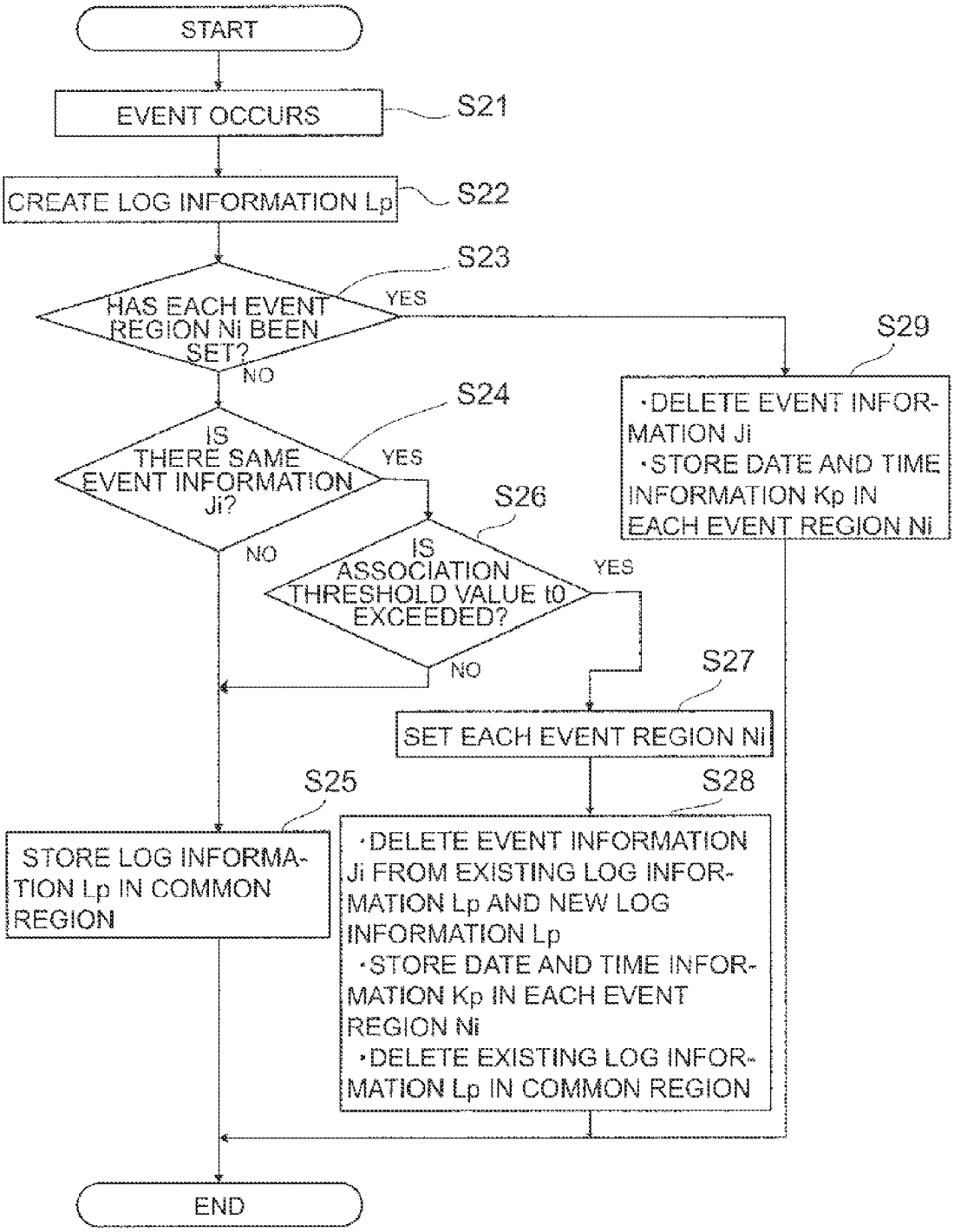
FIG. 6 is a flowchart showing a third exemplary embodiment in which, in the first exemplary embodiment, when event information occurs a number of times that exceeds a preset threshold value, the each event region is set.

FIG. 6 is a flowchart showing a third exemplary embodiment according to the present invention in which, in the first exemplary embodiment, the each event region Ni is set when the event information Ji occurs a number of times that exceeds a preset threshold value t0. It should be noted that the hardware configuration for executing a process of the third exemplary embodiment is same as that in the first exemplary embodiment as shown in FIG. 1.

As shown in FIG. 6, when an event occurs (S21), the CPU 102 in the third exemplary embodiment creates log information Lp corresponding to the event (S22). Subsequently, the CPU 102 determines whether or not an each event region Ni corresponding to the event information Ji included in the created log information Lp has already been set (S23).

If it is determined by the CPU 102 that the each event region Ni has not been set (NO in S23), the CPU 102 determines whether or not event information Ji same as the event information Ji included in the created log information Lp has already been stored in the management table region M (S24).

When it is determined by the CPU 102 that the same event information Ji does not exist in the management table region M (NO in S24), the CPU 102 sets a counter t (illustration thereof is omitted) to 1, and stores the log information Lp, in which the event information Ji and the date and time information Kp are still combined, in the common region (S25), to thereby complete the process.

On the other hand, when the CPU 102 determines that the same event information Ji exists in the management table region M (YES in S24), the CPU 102 increments the counter t provided to the event information Ji by 1, and determines whether or not the counter t exceeds the preset threshold value t0 for performing association (t0<t) (S26). Here, the threshold value t0 is set as a condition for setting the each event region N1, which is a number of times of occurrence of an event of a type corresponding to the event information Ji, where the event information Ji corresponding to the each event region Ni has to exceed the value.

For example, when 2 is set as the threshold value t0, the CPU 102 determines that, when the counter t is 2, the counter t does not exceed the threshold value t0 (t t0) (NO in S26), and determines that, when the counter t is 3, the counter t exceeds the threshold value t0 (t0<t) (YES in S26).

Then, if the CPU 102 determines that the counter t does not exceed the threshold value t0 (NO in S26), the CPU 102 stores the log information Lp, in which the event information Ji and the date and time information Kp are still combined, in the common region (S25), to thereby complete the process.

On the other hand, if the CPU 102 determines that the counter t exceeds the threshold value t0 (YES in S26), the CPU 102 sets the each event region Ni corresponding to the event information Ji included in the log information Lp (S27). Further, the CPU 102 deletes the event information Ji from the log information Lp, and stores the data and time information Kp having been left in the each event region Ni that has been set (S28). In addition, the CPU 102 deletes event information Ji from the log information Lp, which includes the same event information Ji and has already been stored in the common region, stores the date and time information Kp having been left in the each event region Ni that has been set, and deletes the log information Lp from the common region (S28), to thereby complete the process.

It should be noted that, if it is difficult to immediately execute deletion of the log information Lp, which has been stored in a form associating the date and time information Kp with the event information Ji, from the common region for the reason of performance of the image forming apparatus 10, the deletion may be executed at the timing of an idling state of the image forming apparatus 10.

When the CPU 102 determines in S23 that the each event region Ni is set (YES in S23), the CPU 102 deletes the event information Ji from the log information Lp, and stores the date and time information Kp having been left in the each event region Ni corresponding thereto (S29), to thereby complete the process.

With the log storage device 50, the image forming apparatus 10 and the program of the third exemplary embodiment as configured above, in addition to the operations and effects of the first exemplary embodiment, it is possible to store the date and time information Kp in a form of being associated with the event information Ji only in a case where frequency of occurrence of each event exceeds a preset number of times (threshold value t0).

Fourth Exemplary Embodiment

The log storage device 50, the image forming apparatus 10 and the program in each of the first to third exemplary embodiments are examples of dynamically setting the each event region Ni in the storage region corresponding of the state of occurrence of the event information Ji. However, there is also a case where it is impossible to randomly set a region in the storage region.

In other words, in a case where a nonvolatile memory, such as the NVRAM 105, is used as the storage region for setting the management table region M or the each event region Ni, since the nonvolatile memory basically requires a continuous region, there are some cases where it is impossible to apply the first to third exemplary embodiments that dynamically set the each event region Ni. However, in a case where a function that allows additional writing with ease, such as a file system, is adopted, any of the first to third exemplary embodiments is able to be applied as it is.

Then, other than the common region, it may be possible to separate and reserve part of the storage region in advance as the each event region Ni, and to store only the log information Lp corresponding to the event of high frequency of occurrence in a form of being associated with the event information Ji.

Figure 7:
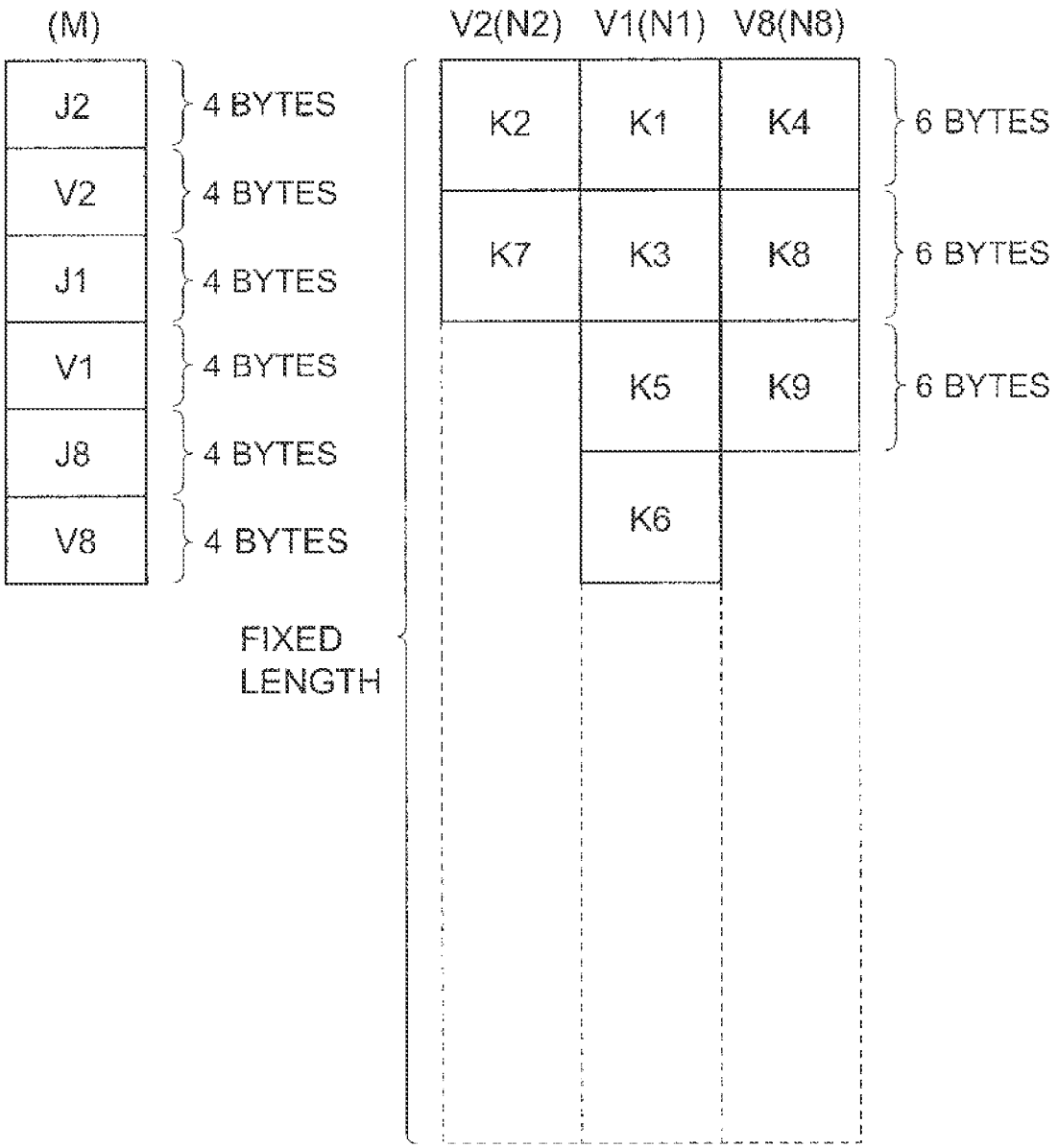
FIG. 7 is a schematic diagram in a case where the management table region and the each event region are set in a storage region in an NVRAM.

FIG. 7 is a schematic diagram in a case where the management table region M and the each event region Ni are set in a storage region in the NVRAM 105.

Here, the management table region M is constituted by a region in which pieces of event information Ji corresponding to three events, of the events that has occurred a number of times exceeding a preset threshold value t0, which are earlier ones in the order of exceeding the threshold value t0 (in FIG. 7, three pieces of event information J2, J1 and J8 are exemplified), are stored, and a region in which pieces of address information Vi (in FIG. 7, three pieces of address information V2, V1 and V8 are exemplified) of the each event regions Ni (in FIG. 7, three each event regions N2, N1 and N8 are exemplified) that are set corresponding to the three pieces of stored event information Ji are specified.

The size of the region that stores each of the pieces of event information J2, J1 and J8 is 4 bytes, and the size of the region that stores each of the pieces of address information V2, V1 and V8 is also 4 bytes, and the pieces of event information J2, J1 and J8 are paired with the pieces of address information V2, V1 and V8, corresponding thereto, respectively, to be stored in the management table region M.

The each event regions N2, N1 and N8 are set in advance with contiguous fixed lengths in the storage regions identified by the pieces of address information V2, V1 and V8, respectively.

Figure 8:
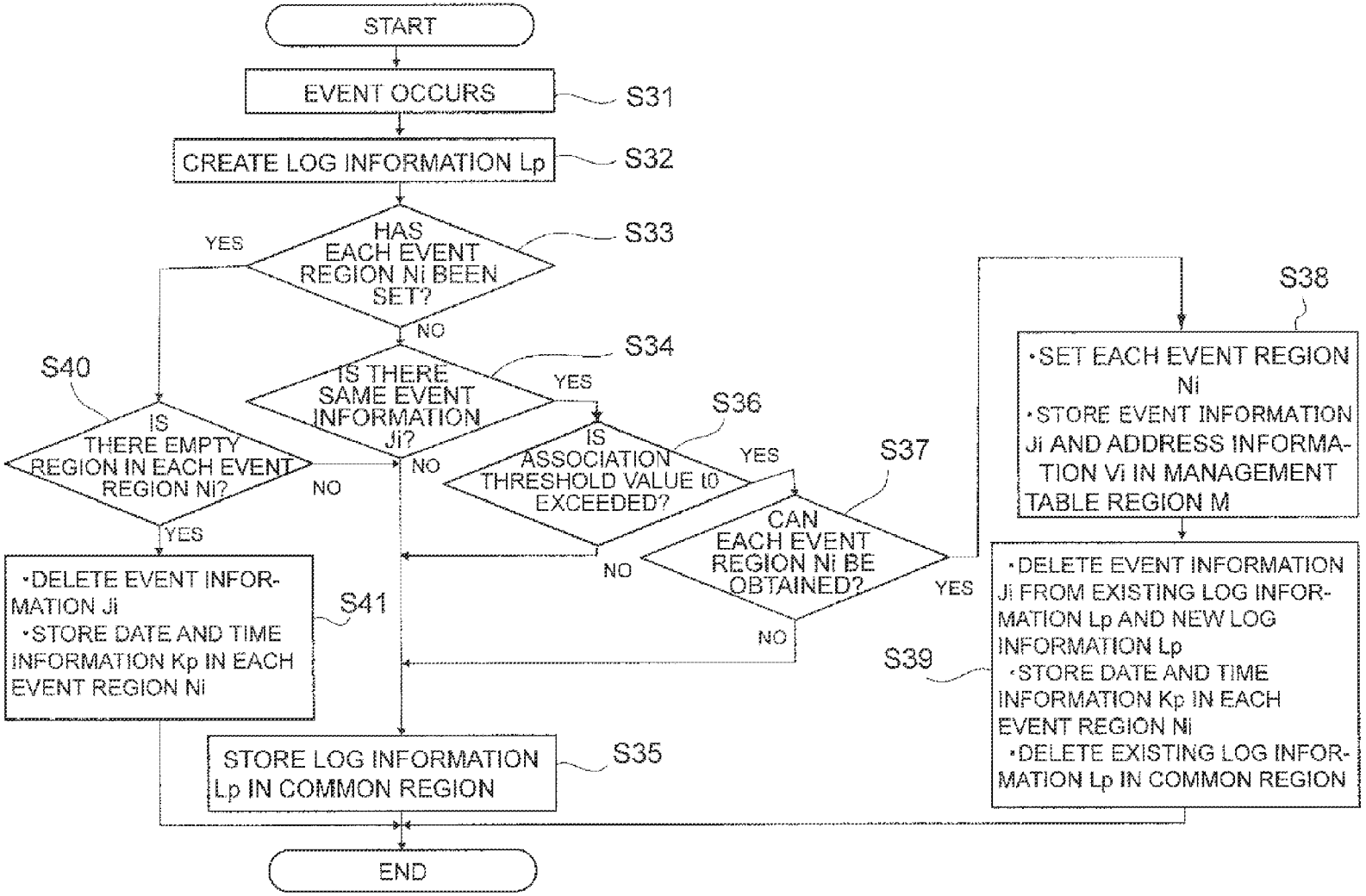
FIG. 8 is a flowchart showing a fourth exemplary embodiment in which, in the first exemplary embodiment, when event information occurs a number of times that exceeds a preset threshold value, each event regions corresponding to three earliest occurrence of event information exceeding the threshold value are set.

FIG. 8 is a flowchart showing a fourth exemplary embodiment according to the present invention in which, in the first exemplary embodiment, when the event information Ji occurs a number of times that exceeds a preset threshold value t0, the each event regions Ni corresponding to earlier three occurrences exceeding the threshold value t0 are set. It should be noted that the hardware configuration for executing a process of the fourth exemplary embodiment is same as that in the first exemplary embodiment as shown in FIG. 1.

As shown in FIG. 8, when an event occurs (S31), the CPU 102 in the fourth exemplary embodiment creates log information Lp corresponding to the event (S32). Subsequently, the CPU 102 determines whether or not an each event region Ni corresponding to the event information Ji included in the created log information Lp has already been set (S33).

If it is determined by the CPU 102 that the each event region Ni has not been set (NO in S33), the CPU 102 determines whether or not event information Ji same as the event information Ji included in the created log information Lp has already been stored in a common region set in the storage region of the NVRAM 105 separately from the management table region M and the each event region Ni (S34).

When it is determined by the CPU 102 that the same event information Ji does not exist in the common region (NO in S34), the CPU 102 sets a counter t (illustration thereof is omitted) to 1, and stores the log information Lp, in which the event information Ji and the date and time information Kp are still combined, in the common region (S35), to thereby complete the process.

On the other hand, when the CPU 102 determines that the same event information Ji exists in the common region (YES in S34), the CPU 102 increments the counter t provided to the event information Ji by 1, and determines whether or not the counter t exceeds the preset threshold value t0 for association (t0<t) (S36). Here, the threshold value t0 is set as a condition for setting the each event region N1, which is a number of times of occurrence of an event of a type corresponding to the event information Ji, where the event information Ji corresponding to the each event region Ni has to exceed the value.

Then, if the CPU 102 determines that the counter t does not exceed the threshold value t0 (NO in S36), the CPU 102 stores the log information Lp, in which the event information Ji and the date and time information Kp are still combined, in the common region (S35), to thereby complete the process.

On the other hand, if the CPU 102 determines that the counter t exceeds the threshold value t0 (YES in S36), the CPU 102 determines whether or not a region preserved for the each event region Ni is still left, namely, whether or not the each event region Ni can be obtained (S37).

When the storage region corresponding to three each event regions Ni has already been set as three specific each event regions Ni, the CPU 102 determines that it is impossible to obtain the each event region Ni. On the other hand, of the storage region corresponding to the three each event regions Ni, when the storage region corresponding to at least one each event region Ni is left, the CPU 102 determines that it is possible to obtain the each event region Ni.

If the CPU 102 determines that it is impossible to obtain the each event region Ni (NO in S37), the CPU 102 stores the log information Lp, in which the event information Ji and the date and time information Kp are still combined, in the common region (S35), to thereby complete the process.

On the other hand, if the CPU 102 determines that it is possible to obtain the each event region Ni (YES in S37), the CPU 102 obtains the each event region Ni, makes a pair of the address information Vi and the event information Ji of the obtained each event region Ni, and stores the pair in the management table region M (S38).

Further, the CPU 102 deletes the event information Ji from the log information Lp, and stores the data and time information Kp having been left in the obtained each event region Ni (S39). In addition, the CPU 102 deletes event information Ji from the log information Lp, which includes the same event information Ji and has already been stored in the common region, stores the date and time information Kp having been left in the obtained each event region Ni, and deletes the log information Lp from the common region (S39), to thereby complete the process.

It should be noted that, if it is difficult to immediately execute deletion of the log information Lp, which has been stored in a form associating the date and time information Kp with the event information Ji, from the common region for the reason of performance of the image forming apparatus 10, the deletion may be executed at the timing of an idling state of the image forming apparatus 10.

When the CPU 102 determines in S33 that the each event region Ni is set (YES in S33), the CPU 102 determines whether or not the each event region Ni has an empty region necessary to additionally store the date and time information Kp of the log information Lp (S40).

When the CPU 102 determines that there is an empty region (YES in S40), the CPU 102 deletes the event information Ji from the log information Lp, and stores the date and time information Kp having been left in the each event region Ni corresponding thereto (S41), to thereby complete the process.

On the other hand, when the CPU 102 determines that there is no empty region (NO in S40), the CPU 102 stores the log information Lp, in which the event information Ji and the date and time information Kp are still combined, in the common region (S35), to thereby complete the process.

With the log storage device 50, the image forming apparatus 10 and the program of the fourth exemplary embodiment as configured above, in addition to the operations and effects of the first exemplary embodiment, even in the case where the nonvolatile memory, such as the NVRAM 105, is used as the storage region for setting the management table region M or the each event region Ni, it is possible to store the log information Lp in a form that associates the date and time information Kp with the event information Ji.

Moreover, with the log storage device 50, the image forming apparatus 10 and the program of the fourth exemplary embodiment, also in a case where it becomes impossible to store the date and time information Kp in a form of being associated with the event information Ji in the each event region Ni, loss of the log information Lp can be avoided by storing the log information Lp as it is in the common region.

Each of the first to fourth exemplary embodiments adopts the date and time information Kp as the accompanying information of the present invention; however, the accompanying information of the present invention is not limited to the date and time information Kp.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A history storage device comprising:

a generating unit configured to generate history information including event information corresponding to an event having occurred and accompanying information accompanying the event information, the event related to supply of sheets or image formation onto a sheet;

a determining unit, in storing first history information in a storage region, configured to determine whether or not the event information included in the first history information is the event information in second history information having already been stored in the storage region;

a setting unit, when event information included in the first history information is determined to be the event information included in the second history information, configured to not set the storage region to store the event information included in the first history information and set the storage region to store the accompanying information included in the first history information in a region corresponding to the event information included in the first history information within the storage region; and a reconstruction unit, in reading out the first history information from the storage region, based on the region in which the accompanying information included in the first history information has been stored, configured to associate the event information with the accompanying information included in the first history information to reconstruct the first history information.

2. The history storage device according to claim 1, wherein, when the event information included in the first history information is the event information included in the second history information having already been stored in the storage region and a number of times of generating the same event information exceeds a preset number, the setting unit configured to not set the storage region to store the event information included in the first history information and set the storage region to store the accompanying information which is included in the first history information.

3. The history storage device according to claim 1, wherein, when the event information included in the first history information satisfies a preset condition, the setting unit configured to not set the storage region to store the event information included in the first history information and set the storage region to store the accompanying information which is included in the first history information.

4. The history storage device according to claim 2, wherein, when the event information included in the first history information satisfies a preset condition, the setting unit configured to not set the storage region to store the event information included in the first history information and set the storage region to store the accompanying information which is included in the first history information.

5. The history storage device according to claim 1, wherein a group information region associated with the each event information is set in the storage region, and the setting unit configured to set the storage region to store the accompanying information accompanying the event information in the group information region associated with the event information, to thereby associate the accompanying information with the event information.

6. The history storage device according to claim 2, wherein a group information region associated with the each event information is set in the storage region, and the setting unit configured to set the storage region to store the accompanying information accompanying the event information in the group information region associated with the event information, to thereby associate the accompanying information with the event information.

7. The history storage device according to claim 3, wherein a group information region associated with the each event information is set in the storage region, and the setting unit configured to set the storage region to store the accompanying information accompanying the event information in the group information region associated with the event information, to thereby associate the accompanying information with the event information.

8. The history storage device according to claim 4, wherein a group information region associated with the each event information is set in the storage region, and the setting unit configured to set the storage region to store the accompanying information accompanying the event information in the group information region associated with the event information, to thereby associate the accompanying information with the event information.

9. The history storage device according to claim 5, wherein, when a capacity of an empty region in the group information region is less than a capacity required to store the accompanying information associated with the event information, the setting unit configured to set another storage region to store the first history information including the event information, the another storage region being different from the group information region.

10. The history storage device according to claim 6, wherein, when a capacity of an empty region in the group information region is less than a capacity required to store the accompanying information associated with the event information, the setting unit configured to set another storage region to store the first history information including the event information, the another storage being different from the group information region.

11. The history storage device according to claim 7, wherein, when a capacity of an empty region in the group information region is less than a capacity required to store the accompanying information associated with the event information, the setting unit configured to set another storage region to store the first history information including the event information, the another storage region being different from the group information region.

12. The history storage device according to claim 8, wherein, when a capacity of an empty region in the group information region is less than a capacity required to store the accompanying information associated with the event information, the setting unit configured to set another storage region to store the first history information including the event information, the another storage region being different from the group information region.

13. An image forming apparatus comprising:

an image forming part that forms an image on a supplied recording medium; and a history storage device including:

a generating unit configured to generate history information including event information corresponding to an event having occurred and accompanying information accompanying the event information, the event related to supply of sheets or image formation onto a sheet;

a determining unit, in storing first history information in a storage region, configured to determine whether or not the event information included in the first history information is the event information in second history information having already been stored in the storage region;

a setting unit, when event information included in the first history information is determined to be the event information included in the second history information, configured to not set the storage region to store the event information included in the first history information and set the storage region to store, the accompanying information included in the first history information in a region corresponding to the event information included in the first history information within the storage region; and a reconstruction unit, in reading out the first history information from the storage region, based on the region in which the accompanying information included in the first history information has been stored, configured to associate the event information with the accompanying information included in the first history information, to reconstruct the first history information.

14. A non-transitory computer readable medium storing a program that causes a computer to execute a process comprising:

generating history information including event information corresponding to an event having occurred and accompanying information accompanying the event information, the event related to supply of sheets or image formation onto a sheet;

determining whether or not the event information included in the first history information is the event information in second history information having already been stored in a storage region;

in a case when event information included in the first history information is determined to be the event information included in the second history information, not setting the storage to store the event information included in the first history information and setting the storage region to store the accompanying information included in the first history information in a region corresponding to the event information included in the first history information within the storage region; and in reading out the first history information from the storage region, based on the region in which the accompanying information included in the first history information has been stored, associating the event information with the accompanying information included in the first history information, to reconstruct the first history information.

* * * * *